United States Patent [19]

Priest

[11] 3,990,314

[45] Nov. 9, 1976

[54] MECHANICALLY LIMITED ROTATIONAL APPARATUS

[75] Inventor: Duane D. Priest, Mount Vernon, Iowa

[73] Assignee: Rockwell International Corporation, El Segundo, Calif.

[22] Filed: Oct. 14, 1975

[21] Appl. No.: 621,931

[52] U.S. Cl. ..... 74/10.2

[51] Int. Cl.[2] ..... G05G 5/04; G05G 5/06

[58] Field of Search ..... 74/10.2, 10.41; 116/115; 192/138, 139

[56] References Cited

UNITED STATES PATENTS

| | | | |
|---|---|---|---|
| 2,746,573 | 5/1956 | Hastings | 192/139 X |
| 2,905,009 | 9/1959 | Bollenbacher et al. | 74/10.2 X |
| 3,012,447 | 12/1961 | Wallace | 74/10.2 X |
| 3,015,793 | 1/1962 | Fraser et al. | 74/10.2 X |
| 3,486,386 | 12/1969 | Laubenfels | 74/10.2 |
| 3,662,610 | 5/1972 | Thoen | 74/10.2 |
| 3,760,640 | 9/1973 | Mayer et al. | 74/10.41 X |

*Primary Examiner*—Allan D. Herrmann

*Attorney, Agent, or Firm*—Bruce C. Lutz; Robert J. Crawford

[57] ABSTRACT

Digital indicating means for displaying two series of numbers, one of which commences repeating. The repeating series of numbers is limited in rotation in the embodiment shown between 360° and 720° by a bi-positional pawl cam-follower which interacts with two stops on a cam. The pawl displays one series of digits while the cam displays a second series of digits.

6 Claims, 7 Drawing Figures

MECHANICALLY LIMITED ROTATIONAL APPARATUS

THE INVENTION

The present invention pertains generally to mechanical apparatus and more specifically to a cam and pawl cam-follower arrangement wherein the cam and pawl interact with two stops on the cam such that the cam is limited in rotational movement to a predetermined amount between 360 and 720 rotational degrees.

While it is simple to mechanically limit rotation of a shaft to some range less than 360°, the limiting of the same shaft to a rotation between 360° and 720° becomes immediately much more complex and costly. The present invention provides a simple and cost-effective apparatus for providing such an angular limitation. In use, the inventive combination is used for electrical control and digital indication of the frequencies being generated in a frequency generator between the frequencies of 2XX kHz and 17XX kHz. This range of frequencies covers the Marine transmission frequency band at the low end and the AM broadcast band at the upper end. The XX represents additional controls for providing frequency steps of less than 100 kHz.

The operation of this device is obtained by attaching a cam with two discrete positional stops to the indicating device for indicating incremental steps of 100 kHz. Interacting with this cam is a pawl which provides indications of 1000 kHz increments and is biased to a first or "zero" position. Rotation of the cammed device will move the pawl to a second or "one" position. In each of the positions, it will interact with appropriate stops on the cam to limit rotation. In the embodiment illustrated, this rotation is limited to 540° of travel.

It is therefore an object of the present invention to provide an improved rotation limiting device. Other objects and advantages of the present invention will be apparent from a reading of the specification and appended claims in conjunction with the drawings wherein:

Figure 1:
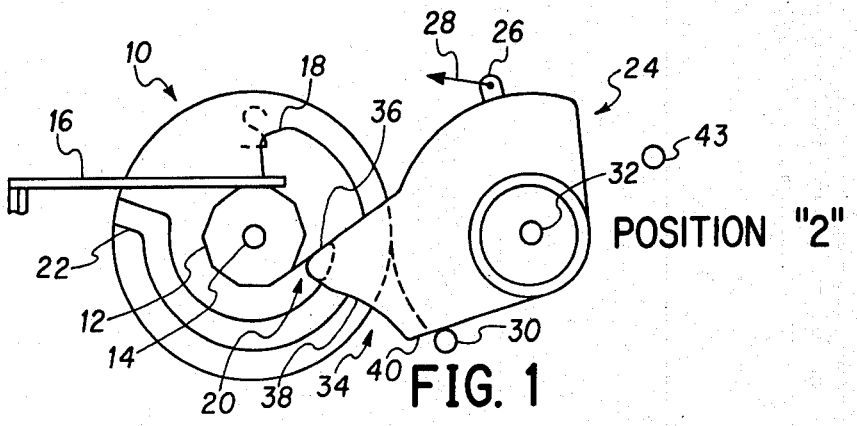
FIG. 1 illustrates the cam and pawl arrangement at a first rotational stop.

In FIG. 1, a cam or rotational device generally designated as 10, has a central decagon portion 12 which encloses a shaft 14. The decagon portion 12 coacts with a detent mechanism illustrated as a spring biased lever 16. FIG. 1 illustrates the apparatus from the reverse side of the indicia and thus a backwards 2 is illustrated in dash lines as appearing on and being visible from the other side of the cam mechanism 10. A bearing surface 18 is illustrated on one portion of the cam with a first stop or limiting means 20 adjacent the decagon 12 and a second stop or limiting means 22 near the periphery of the cam 10. A pawl, spur or arm cam-follower generally designated as 24 has a first projection or protrusion 26 which is attached to a spring or other biasing member 28. This normally holds the pawl 24 in a first position. This first position, as illustrated, shows a mechanical stop 30 which prevents the pawl from moving any farther than the position illustrated in the counterclockwise direction. Pawl 24 rotates on a central shaft 32. An extremity generally designated as 34 contains a stop projection 36 which interacts with stop 20 adjacent the end of a path, track or channel in cam 10 to limit rotation of cam 10 in the first (clockwise) direction (as viewed from the back in FIGS. 1–4). A bearing surface 38 of extremity 34 interacts with portion 18 of cam 10 while moving the pawl 24 counterclockwise from the position shown in FIG. 1 to a second position. A stop portion 40 of extremity 34 interacts with the stop 22 to limit counterclockwise (CCW) rotation of cam 10 to its second rotational limit position of FIG. 4.

All the numbers utilized above are utilized in each of the remaining figures where that portion of the arrangement is discussed.

Figure 2:
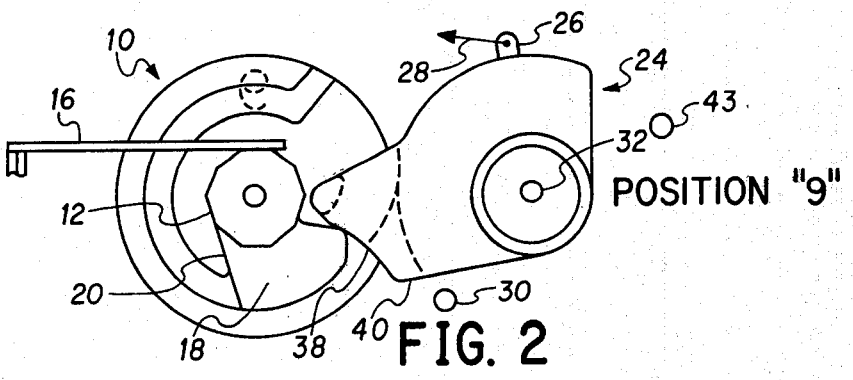
FIG. 2 illustrates the cam and pawl arrangement at the beginning of movement of the pawl to a second position.

In FIG. 2, the cam has rotated CCW to provide an indication of 9 to the observer on the other side of the cam arrangement. At this position, the pawl 24 is commencing to move away from stop or pin 30, but again is restrained from moving by the biasing means 28 attached to extremity 26. The movement of pawl 24 is initiated by interaction of the cam bearing surface portion 18 against the bearing surface 38 of pawl 24. As indicated, the arm 16, which is normally of a spring-like material, acts as detent to promote movement of the cam 10 by 36° increments such that the indicia is centered in an opening in the display panel.

Figure 3:
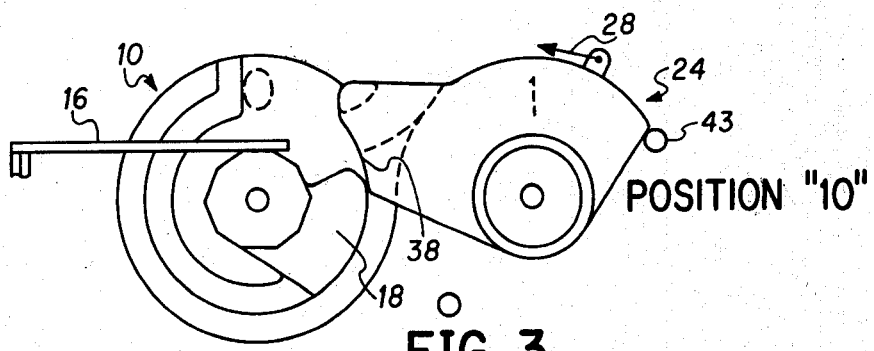
FIG. 3 illustrates the cam and pawl arrangement as the pawl completes its movement to the second position.

In FIG. 3, the pawl 24 has completed its movement to its new position and the indicia, illustrated in dash lines, provide an indication of 10. Again, the spring 28 attempts to return the pawl 24 to the position shown in FIG. 1, but is prevented from doing so by the interaction of the bearing surface 18 of cam 10 and the bearing surface 38 of pawl 24. As cam 10 is rotated further in the counterclockwise direction, the pawl 24 stays in the position shown.

Figure 4:
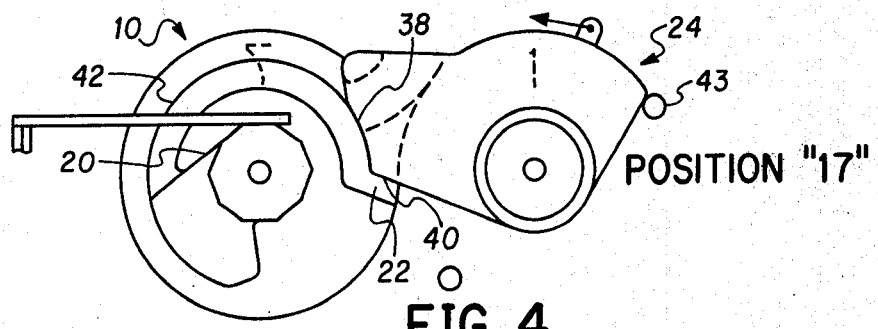
FIG. 4 illustrates the cam and pawl with the cam at its second limit of rotation.

In FIG. 4, the pawl 24 is shown in the same position as illustrated in FIG. 3. The bearing surface 38 continues to ride on the cam 10 and follows the circular configuration of a bearing surface 42. However, in FIG. 4, the bearing surface 42 terminates in the second stop or limit means 22 which interacts with portion 40 of pawl 24. Thus, counterclockwise rotation of cam 10 is limited at an angle which is 540° from the start as illustrated in FIG. 1 and provides an indication of 7. To prevent pawl 24 from moving beyond the position shown in FIG. 4, a pin or stop 43, similar to 30, is used.

Observation of the FIGS. 1 through 4 will illustrate that the limits chosen where picked for design purposes. In other words, the stops 20 and 22 may be repositioned so that the clockwise rotation of cam 10 can be varied in such a manner that if there are indicia as shown, the indicia limit will vary from 0 to 9. Likewise, the stop 22 can be varied in position such that if indicia are used on the spur 24 and the cam 10, the indication thereon would range as a limit from 10 to 19.

Figure 5:
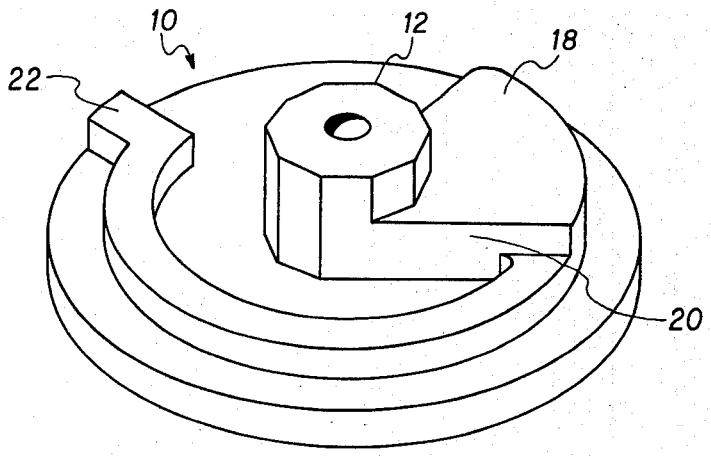
FIG. 5 is an isometric drawing of the cam.
Figure 6:
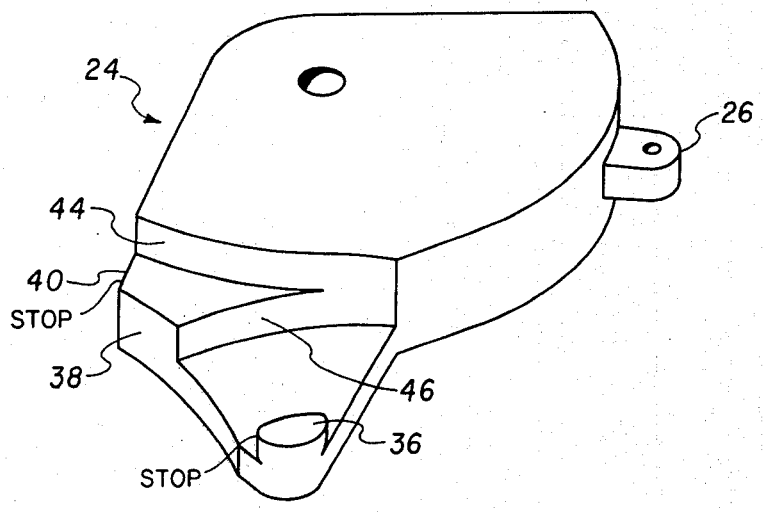
FIG. 6 is an isometric drawing of the reverse side of the pawl.

FIGS. 5 and 6 more clearly illustrate in isometric detail the interacting limits and limit stops of the two pieces along with the cam bearing surface and the pawl bearing surface. As illustrated and as may be ascertained from FIGS. 1 through 4, the projection 36 interacts with slot ending in stop 20 to provide one limit while the stop 40 of spur 24 interacts with stop 22 to prevent further rotation of cam 10 in the opposite direction. Surfaces 44 and 46 have no particular function other than being far enough away from projection 36 to clear all pertinent surfaces of cam 10.

Figure 7:
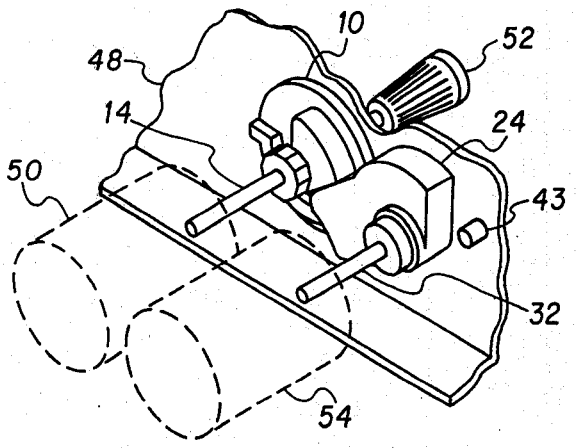
FIG. 7 is an isometric view of the cam and pawl arrangement attached to shafts as used in a preferred embodiment for a panel mount.

In FIG. 7, a base or panel mounting means 48 is illustrated with a cam 10 attached to a shaft 14 extending therethrough. A potentiometer, wafer switch, or other load 50 is attached to one end of shaft 14 while a knob 52 is attached to the other end. The indicia on cam 10 as illustrated in FIG. 1 may be seen from the knob side of the panel 48. An opening in panel 48 will also illustrate the indicia on spur 24 which is mounted on a shaft 32 also connected to base 48. Again, a load such as a wafer switch or potentiometer 54 is attached to shaft 32.

Although the preferred embodiment of the rotational limiting apparatus is used with switches, a knob and indicia in frequency indicating and generating apparatus, the inventive concept lies in the mechanism for limiting rotation of a member such as cam 10 to a total rotational movement of some amount greater than 360°. If more than 720° is desired for the cam 10, the pawl will normally have more than two positions. Therefore, I wish to be limited not by the embodiment illustrated, but only by the scope of the appended claims.

What is claimed is:

1. Limited range rotational apparatus comprising, in combination:

base means;

cam means mounted on said base means and including first and second stops and at least one bearing surface independent of said stops;

pawl means mounted on said base means juxtaposed said cam means and including an arm having at least one further bearing surface and third and fourth stops; and biasing means attached to said pawl means for normally holding said pawl means in a first position whereby said third stop cooperates with said first stop to limit rotation of said cam means in a first direction, rotation of said cam means in a second direction, opposite said first direction, causing interaction of said bearing surfaces whereby said pawl means is moved to further positions, said second and fourth stops cooperating to allow total rotational movement of said cam means to exceed 360° and to limit total rotational movement to a predetermined angle.

2. Mechanical means for limiting total rotational ability of a shaft to a range between 360° and 720° comprising, in combination:

base means;

shaft means attached to said base means;

cam means rotationally operated by said shaft means, said cam means including first and second stops and a bearing surface; and pawl means, including a single arm, attached to said base means and normally biased in a first position wherein a projection on said arm reacts with said first stop to limit rotation of said cam in a first direction, rotation of said cam in an opposite direction being limited to less than 720° through interaction of said pawl means and said second stop after interaction of said bearing surface and said pawl prior to the first 360° of rotation to transpose said pawl to a second position.

3. Apparatus as claimed in claim 2 comprising in addition indicia on said cam and pawl means providing an indication of total rotational travel.

4. Apparatus as claimed in claim 2 comprising, in addition indicia on said cam means.

5. Apparatus as claimed in claim 2 comprising, in addition:

load means attached to said shaft means; and indicia on said cam means and said pawl means.

6. Angular motion limiting apparatus comprising, in combination:

base means;

cam means, attached to said base means, for rotation of greater than 360°, said cam means including a first stop at the end of a recessed path and a second stop; and pawl cam-follower means juxtaposed in a first position with said cam means, said pawl means including an arm having a projection for interacting with said first stop at the end of said recessed path to prevent further movement of said cam means in a first direction of rotation, rotational movement of said cam means in a direction opposite said first direction causing interaction between said cam means and said pawl means to move said pawl means to a further position prior to rotational movement of said cam means by 360°, further rotational movement of said cam means of more than 360° in said opposite direction producing interaction of said pawl means and said second stop of said cam means to prevent further rotational movement of said cam means in said opposite direction.

* * * * *